United States Patent [19]

Campbell

[11] Patent Number: 4,646,988

[45] Date of Patent: Mar. 3, 1987

[54] TUBE GRIPPER

[75] Inventor: Arlin L. Campbell, Greensboro, N.C.

[73] Assignee: Burlington Industries, Inc., Greensboro, N.C.

[21] Appl. No.: 719,958

[22] Filed: Apr. 4, 1985

[51] Int. Cl.[4] ..... B65H 75/24

[52] U.S. Cl. ..... 242/110.2

[58] Field of Search ..... 242/72 R, 72.1, 110.2, 242/68.3; 269/48.1; 279/2 R

[56] References Cited

U.S. PATENT DOCUMENTS

| | | | |
|---|---|---|---|
| 2,296,662 | 9/1942 | Greenaway | 242/110.2 |
| 2,734,691 | 2/1956 | Godat | 242/72 R |
| 3,897,915 | 8/1975 | Budzyna | 242/110.2 X |
| 4,159,085 | 6/1979 | Ross | 242/110.2 |
| 4,485,987 | 12/1984 | Simpson | 242/130.1 |

*Primary Examiner*—John M. Jillions

*Attorney, Agent, or Firm*—Cushman, Darby & Cushman

[57] ABSTRACT

A device for gripping the interior surface of a tube on which yarn or other material may be wrapped is provided with a hollow shaft in which is mounted an actuating member for sliding towards and away from a plug on the distal end of the shaft; a plurality of linkage arms are provided with a pair of arms being pivotally connected to each other with the remote ends of the arms respectively connected to the actuating member and the plug; the adjacent ends of the arms of each pair are pivotally connected to a pad of relatively narrow thickness so that when the actuating member moves away from the distal end of the shaft, the linkage arms will retract the pad to a position substantially within the hollow shaft.

11 Claims, 5 Drawing Figures

TUBE GRIPPER

BACKGROUND AND SUMMARY OF THE INVENTION

The present invention relates to gripping devices for tubular elements such as the tubes on which yarn packages, often of substantial weight, are wrapped for delivery from a yarn manufacturer to a yarn user. More particularly, the apparatus of the present invention will enable a user, such as a worker, a robot or other mechanical device, to grip yarn tubes or other similar tubular elements where the interior diameter of the tube varies over a wide range and where the overall weight of the material mounted on the tube also varies considerably. In addition, the apparatus will grip both cylindrical and conical yarn tubes.

In the past, where manufacturers have had to employ articles such as yarn, wire or the like which are supplied from a manufacturer with the article wrapped for transportation and storage onto tubular supports, a number of employees have had to be assigned to the task of unloading and installing the individual packages on machines that utilize the material. Thus, the process of transporting and storing materials that are wrapped on tubular supports has been very labor intensive.

In the textile industry, the use of yarns wrapped on tubes has been a common practice for a large number of years. The handling by individual workers of individual packages has been one of the problems in reducing textile manufacturing costs as well as a source for a number of quality control difficulties. Specifically, in textile plants, the handling of yarns would often result in soiling of the exterior of the yarn packages. In addition, any accidents in connection with the packages, such as caused by collisions or dropping of individual packages often results in a total loss of the individual package so affected. To minimize such losses, mechanical devices have been developed to handle yarn packages with automatic control. However, effective yarn package gripping devices are required.

In a number of textile operations, in recent years, improvements in machine design have resulted in substantially increased production speeds. As a result, manufacturers have resorted to increasing the package size often to ponderous weight making it difficult or impossible for individual workers to manually handle the packages. For example, in present day false twist texturing machines which operate at linear speeds on the order of 600 to 800 yards/minute or more, a worker must place a tubular support yarn package on a yarn creel which holds a large number of such packages and which is placed adjacent to the machine. Such texturing machines are provided with a number of yarn texturing positions, each of which must be individually threaded. The yarn is passed through a position and is taken up on a take-up package as the yarn is processed. When the take-up package reaches its capacity, a worker must remove the take-up package and rethread the position from a supply package on the creel. Supply and take-up packages weighing 25 lbs. or even more are not uncommon so that worker fatigue can slow the production in a very short time.

Even without robotic systems, the present invention can greatly reduce this disadvantage by providing a mechanical tube gripping device which may be powered to assist in moving large tubular yarn packages and is particularly effective since the device can be utilized where the internal diameter of the tubes varies in size or even shape.

According to the present invention, a hollow shaft is provided which may be attached to any suitable support member. The support member may be a mechanical device such as a robot or an apparatus which can be easily manipulated by a worker. The shaft is provided with an actuating member which is slidably mounted on the interior of the hollow shaft. One end of the shaft is closed by a support plug and a plurality of linkage arms are connected between the actuating member and the support plug with each pair of linkage arms being pivotally connected and also pivotally connected to a gripping pad. A suitable drive member such as a piston and cylinder with an actuating rod extending from the piston to the actuating member in the shaft may be provided whereby, when the actuating member is moved toward the closed end, the linkage arms will move outwardly from the interior of the shaft through a slot in the wall thereof to move the gripping pads into firm engagement with the interior surface of a tube to securely grip the tube. Thereafter, the support base for the gripping device can be easily manipulated by a mechanical device or by a worker to move the yarn package from one position to another from storage to a textile machine and thereafter from the machine back to storage for packaging and transportation.

The apparatus of the present invention has the advantage over prior art devices in that the hollow shaft may be of small diameter, on the order of an inch, depending upon the weight of the load to be transported. This is achieved by disposing the actuating member such that it need not extend the length of the shaft thereby allowing the linkage arms to retract closer to the center of the shaft. Moreover, the apparatus may be adjusted very simply to accommodate other ranges of tube diameters by simply changing the lengths of the linkage arms and the rest or stop position of the actuating means.

The foregoing and other advantages will become apparent as consideration is given to the following detailed description taken in conjunction with the accompanying drawings, in which:

DETAILED DESCRIPTION OF THE INVENTION

Figure 1:
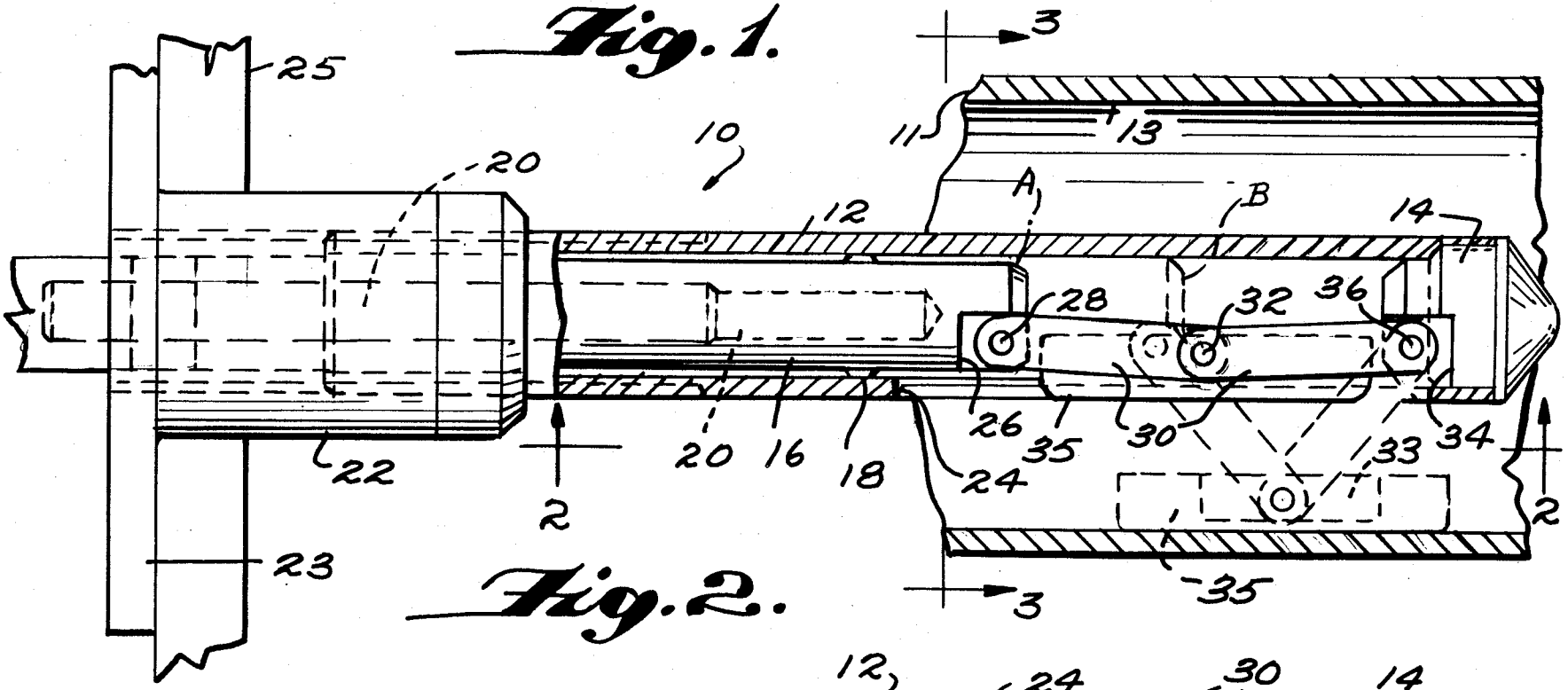
FIG. 1 is a longitudinal view of the gripping device of the present invention with parts broken away for clarity with one end of the device inserted into a portion of a tube.

With reference now to the drawings wherein like numerals designate corresponding parts throughout the several views, there is shown in FIG. 1 the gripping device 10 of the present invention. The device 10 includes a hollow shaft 12 which supports the gripping elements almost entirely on the interior of the shaft. The distal end of the shaft is closed by a threaded, roundly capped support plug 14. On the interior of the shaft, an actuating member 16 is slidably mounted and is provided with a peripheral land 18 which assures accurate movement of the actuating member 16 along the longitudinal axis of the shaft 12. Movement of the actuating member 16 towards and away from the plug 14 may be effected with a number of mechanisms. For example, a stud member 20 may be threadedly engaged with a threaded bore extending along the longitudinal axis of the actuating member 16. The stud 20 at its other end may be connected to a piston rod of a piston and cylinder means which may be air actuated so that when the piston is moved in the piston and cylinder (not shown), a corresponding movement of the actuating member 16 will result. In this embodiment, the relative longitudinal position between the actuating member and the shaft 12 may be adjusted as desired by rotating the actuating member with respect to the stud member. This, accompanied by insertion of linkages 30, to be more fully described below, of suitable length allows the apparatus to grip tubes of other ranges of diameters as long as slot 34 in shaft 12 is made with a sufficient length. In another embodiment, the actuating member 16 may be designed as a piston itself so that fluid under pressure may be introduced into and removed from the shaft 12 to effect movement of the actuating member 16 as described above.

The end of the actuating member closest to the plug 14 is provided with a recessed slot 26 in which is pivotally mounted a linkage arm 30 on a pin 28. At its opposite end, the linkage arm 30 is pivotally mounted on a pivot pin 32. A second linkage arm 30 is also pivotally mounted on the pivot pin 32. These ends of both linkage arms 30 fit snugly together in a recess 33 in the gripping pad 35. The pivot pin 32 spans across the recess 33 at the longitudinal center of the gripping pad 35. The other end of the second linkage arm 30 is pivotally mounted on pin 36 in a recessed slot in the face of the plug 14 closest to the actuating member 16.

Figure 2:
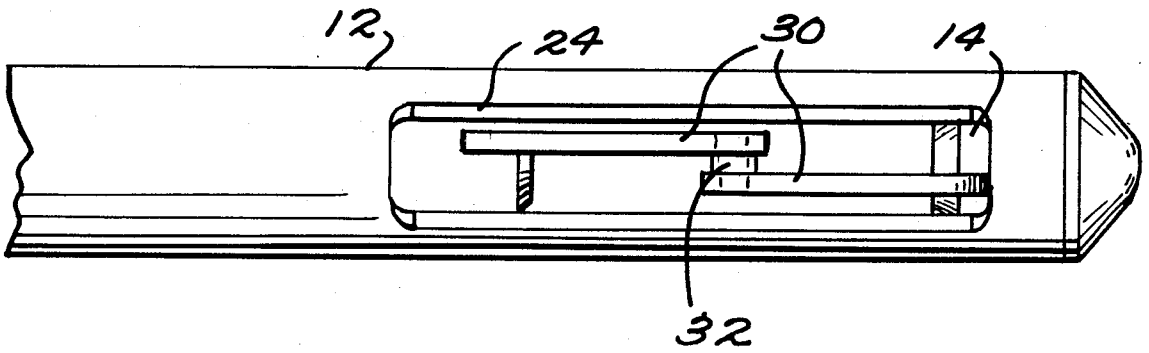
FIG. 2 is a view along lines 2—2 of FIG. 1.
Figure 3:
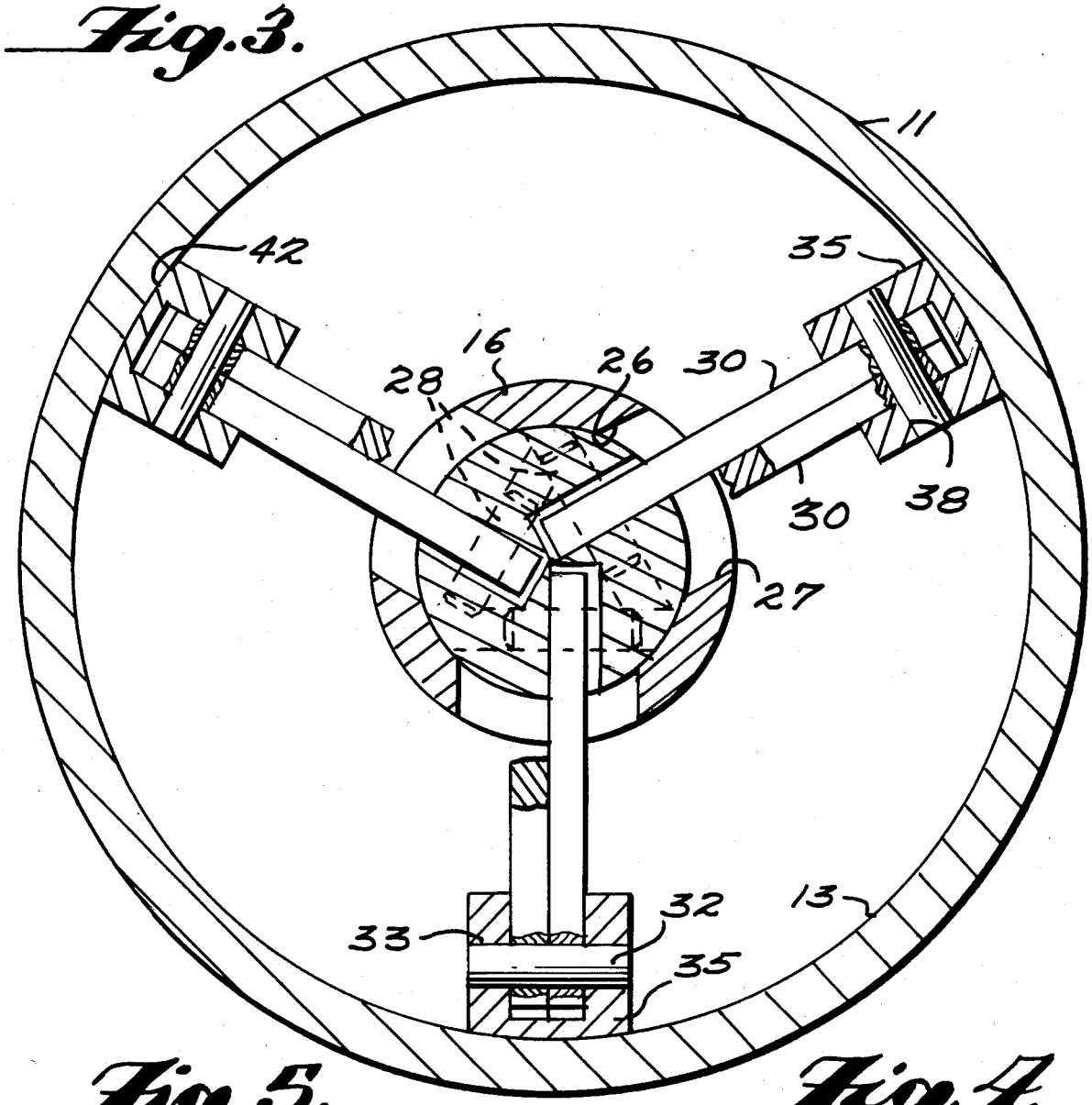
FIG. 3 is an enlarged view along lines 3—3 of FIG. 1.
Figure 5:
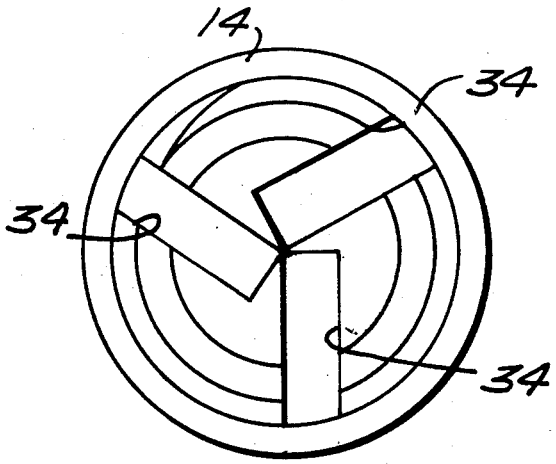
FIG. 5 is an end looking from the left of the device illustrated in FIG. 4.
Figure 4:
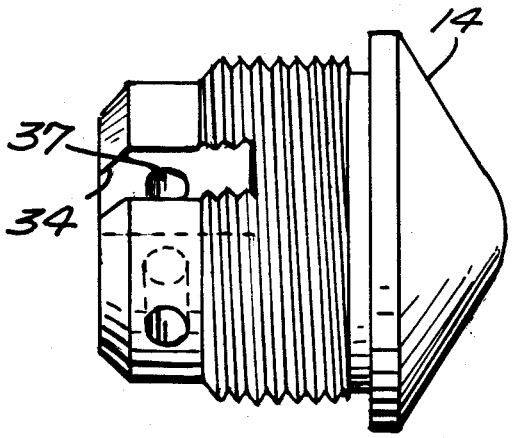
FIG. 4 is an enlarged detailed view of the support plug of the gripping device of FIG. 1.

With this arrangement, upon movement of the actuating member from the position indicated by the letter A in FIG. 1 towards the plug member to the position indicated by the letter B, the linkage arms 30 will be pivoted outwardly through a slot 24 (FIG. 2) provided in the wall of the shaft 12 so that the pad 35 will be moved into gripping position with the interior surface 13 of a tube 11. As shown in FIG. 3, the actuating member 16 may be provided with three connections for three sets of linkage arms 30 for actuating three pads simultaneously as illustrated in FIG. 3. Preferably, the pads are a hard metal with the surfaces which contact tube 11 being roughened or knurled. Other friction enhancing means can also be employed as desired.

As is apparent from FIG. 3, the inner slot 26 is only slightly larger width than the thickness of the linkage arms 30 so as to prevent skewing of the arms 30 on the pivot pins 28.

Similarly, the support plug 14 is provided with recesses 34 which are dimensioned slightly larger than the ends of the linkage arms 30 which are supported therein on pivot pins 36.

With this arrangement, with the actuating member moved away from the plug 14, both the linkage arms and the pads 35 will be substantially fully retracted within the interior of the shaft 12 thus providing a very streamlined exterior surface which facilitates insertion of the gripping device into the tubes to be manipulated. This is a particularly important feature in a robotics application because the presentation of the gripper to the tube to be gripped may not be as accurate as the directly human controlled circumstance. Also, in this context, the rounded shape of the cap of plug 14 and the overall small diameter of shaft 12 are important considerations in facilitating proper insertion of the device into the tube.

Gripping is facilitated by providing a slight curvature to the exterior of the pads as shown at 42 in FIG. 3. Where an air cylinder is employed to move the actuating member, the amount of air pressure supplied can be varied to effect adequate gripping force and to assure accurate control of a package. The pads 35 are pivotable about pins 32 on the arms 30 so that the device will grip noncylindrically shaped interiors, especially conical yarn tubes.

Having described the invention, it will be apparent to those skilled in this art that various modifications may be made thereto without departing from the spirit and scope of this invention as defined in the appended claims.

What is claimed is:

1. A gripping device for hollow articles comprising a hollow shaft having a width that is less than the diameter of the articles to be gripped and having a closed end, a plurality of generally equally spaced slots provided in said shaft adjacent to said closed end, an actuating member disposed in said shaft and spaced from said closed end a selected distance so as to be movable toward and away from said closed end, a plurality of contact means, one for each said slot, each said contact means having a movable linkage means actuatable by said actuating member, each said linkage means including a first arm having one end pivotally attached to said actuating member and another end pivotally attached to said respective contact means, a second arm having one end pivotally attached to said respective contact means and another end pivotally attached adjacent said closed end of said shaft so that, with said shaft inserted into the interior of an article upon movement of said actuating member toward said closed end, each said linkage means will be moved to carry a respective contact means from a first position substantially within said shaft outwardly to a second position to engage an article's interior surface and, upon movement of said actuating member away from said closed end each said linkage means will be moved to carry a respective contact means from said second position to said first position, each said linkage means, when said respective contact means is in said first position, being disposed substantially within said shaft, said actuating member being spaced a distance from said closed end when said contact means is both in said first and in said second positions.

2. The gripping device as claimed in claim 1, wherein said actuating member is a piston slidably mounted in said shaft, said piston having a peripheral portion in engagement with the shaft surface.

3. The gripping device as claimed in claim 1, wherein said contact means is a pad member which, when said contact means is in said first position, is disposed within said shaft so that the external surface of said shaft is streamlined.

4. The gripping device as claimed in claim 3, wherein said pad member has an exterior tube-engaging side and an opposite side having a recess, a pin mounted in said recess connected to a said linkage means.

5. The gripping device as claimed in claim 2, wherein means for delivering fluid under pressure to said shaft are provided to move said actuator member toward said closed end.

6. The gripping device as claimed in claim 1, wherein said actuator member is connected to a fluid actuated piston and cylinder means for moving said actuator member toward and away from said closed end of said shaft.

7. The gripping device as claimed in claim 6 wherein said actuator member is connected by rod means to said piston and cylinder means.

8. The gripping device as claimed in claim 1, wherein said actuating member is adjustable in said shaft to accommodate arms of said linkage means of different length.

9. The gripping device as claimed in claim 6, wherein the relative positions of said actuator member and said piston and cylinder means are adjustable whereby said actuator member can accommodate differently sized linkage means.

10. The gripping device as claimed in claim 1, wherein said closed end is rounded to provide a streamlined shaft external surface.

11. The gripping device as claimed in claim 1, wherein said contact means are pivotally mounted on said linkage means.

* * * * *